US006926505B2

(12) United States Patent
Sbarounis

(10) Patent No.: US 6,926,505 B2
(45) Date of Patent: Aug. 9, 2005

(54) ROTARY MACHINE HOUSING WITH RADIALLY MOUNTED SLIDING VANES

(76) Inventor: Joaseph A. Sbarounis, 138 Prince St., Apt. 1, Boston, MA (US) 02113

( * ) Notice: Subject to any disclaimer, the term of this patent is extended or adjusted under 35 U.S.C. 154(b) by 71 days.

(21) Appl. No.: 10/625,636

(22) Filed: Jul. 23, 2003

(65) Prior Publication Data

US 2005/0017053 A1 Jan. 27, 2005

(51) Int. Cl.[7] ..... F04C 2/00
(52) U.S. Cl. ..... 418/54; 418/125; 418/248
(58) Field of Search ..... 418/54, 248, 125

(56) References Cited

U.S. PATENT DOCUMENTS

| | | | | |
|---|---|---|---|---|
| 298,952 A | | 5/1884 | Donkin | |
| 1,340,625 A | | 5/1920 | Planche | |
| 1,672,422 A | * | 6/1928 | Nelson | 418/248 |
| 3,800,760 A | | 4/1974 | Knee | |
| 3,938,919 A | | 2/1976 | Huf et al. | |
| 3,966,370 A | | 6/1976 | Huf | |
| 4,008,019 A | * | 2/1977 | Carling | 418/15 |
| 4,300,874 A | | 11/1981 | Georgiev | |
| 4,345,886 A | | 8/1982 | Nakayama et al. | |
| 4,594,060 A | * | 6/1986 | Schwab | 418/54 |
| 5,393,208 A | | 2/1995 | Sbarounis | |
| 5,681,156 A | * | 10/1997 | Rapp | 418/54 |
| 6,799,955 B1 | * | 10/2004 | Sbarounis | 418/54 |

FOREIGN PATENT DOCUMENTS

| | | | | |
|---|---|---|---|---|
| GB | 258 | | of 1853 | |
| GB | 2018902 A | * | 10/1979 | F04C/2/00 |

* cited by examiner

*Primary Examiner*—Theresa Trieu
(74) *Attorney, Agent, or Firm*—Fitch, Even, Tabin & Flannery

(57) ABSTRACT

Two or more slidably mounted seals of radially orientation are provided in a rotary machine. One of the slidably mounted seals can be selectably retractable to perform a valving operation with respect to a rotor mounted for eccentric rotary motion within the machine.

26 Claims, 10 Drawing Sheets

ROTARY MACHINE HOUSING WITH RADIALLY MOUNTED SLIDING VANES

BACKGROUND OF THE INVENTION

1. Field of the Invention

The present invention relates to the two-lobe and multi-lobe rotor rotary machine. More particularly, the present invention relates to the use of two or more slidably mounted seals of radial orientation located in the region of the center of the least volume portion that is formed between the rotor apexes in the housing chamber. The radial seals regulate and isolate working volumes within the machine by interaction with the periphery of the rotary piston. The advantages would apply to other epitroidal/epitrochial rotary machines and some advantages would apply to the broad class of trochoidal rotary machines.

2. Description of the Related Art

It is understood that many of the rotary piston machines represented by prior art can be used as a gas expandor. An example of this would be to power the device from high-pressure combustion gases or heated gases. In this context the rotary machine differs in function from turbo machinery or expansion of gases housed within a piston cylinder. The expandor as referred to must admit gases, from a higher pressure source that is not already contained within the volume, and convert the pressure and volume passing into the device to work. The device must then expand the gases to low pressure ideally with an isentropic expansion to extract energy from the internal energy of the gases. Henceforth, flow regulation for two-lobe or multi-lobe rotor rotary machines has represented one of the most challenging design considerations for construction of this type of machine for practical applications.

In U.S. Pat. No. 298,952, by Edwin Bryan Donkin, there is a description of the inward-bend of the cartiodal-housing fitting to the edge of the piston, this being in part trochoidal. The rotor is cut such that the surface follows a point at the inward-bend separating the inlet port and outlet port. Described also are two rotors with peripheries that follow the same point from either side and always mate together. The effect is to allow for ports of very large size whereas without this separation, the ports would be greatly restricted. This technique can also be used to internally regulate the flow such that a small port can be placed at any portion of the region of the larger ports described to provide for small expansion ratios without an external valve. The external valve similar to that described in related prior art would provide additional flow regulation to allow for much higher expansion ratios. The concept of combining the trochoidal and cartiodal design seems to originate first with this patent however radially mounted seals were not well understood. A largely stationary seal in the position described by Donkin would not have a consideration of a wide variation of pressure angles and total travel that would exist for other regions of the housing and rotor. The slidably mounted seal relaxes the geometric constraint if the seal is of such a construction so as to be allowed to adjust for relative movement of the rotor periphery at the point of contact. Positions far removed from this portion of the radial housing do not lend themselves to the use of the slidably mounted seals in general because of excessive total travel and pressure angles. Positions nearer the region of the point contact described in this prior art, however, could accommodate a reciprocating slidably mounted seal. The slidably mounted seal to separate the high pressure port from the low pressure port has not been described for epitroidal configurations relying on rotor apexes to separate working volumes.

Flow regulation by means of an external valve is described for example in U.S. Pat. No. 3,800,760 which also benefits from internal flow regulation by a rocking seal at the tip of the rotor which seals between the two working chambers as they pass over the inlet port and outlet port.

U.S. Pat. No. 4,345,886 refers to a compressor design with vanes in the housing that relies on vanes that reciprocate sliding in vane grooves. The radially inner end of each vane contacts the outer peripheral surface. This patent additionally showed ports could be placed within the rotor and the vanes can act as a valve by passing over these ports.

Similarly, U.S. Pat. No. 3,966,370 describes a rotor with a coordinated design that has minimal vane movement and uses troughs and passages to the rotor center.

U.S. Pat. No. 3,938,919 presents the use of trough shaped recesses in the peripheral piston surface to transfer gases form one working volume of a rotary machine to another.

An improvement in flow regulation of significance for this type of rotary machine would be for the use of a single stage for a compressor or expandor that allows for much larger volumetric ratios. Additionally, a method of displacing the gases contained within the minimum volume region or deriving power from this region with or without an external valve or production of torque at the top dead center position has not been adequately achieved for this type of rotary machine.

SUMMARY OF INVENTION

It is an object of the present invention to provide an improved two lobe or multiple lobe rotor rotary machine for use as a pump or engine.

Another objective of the present invention is to provide a two lobe or multi-lobe rotary machine which greatly reduces the unusable volume at the minimum working volume while avoiding the effects of adverse expansion.

Another objective of the present invention is to reduce the adverse effects of the shock wave that forms in the top dead center position upon opening of the inlet valve when used as an engine.

Another objective of the present invention is to provide the use of a longer crank length for a given size rotor or a smaller rotor for given length of crank.

Another objective is to increase the volume that may be displaced by the rotary machine as compared to the overall size and mass of the rotary machine Another object of the present invention is to provide for a valve that does not require an external control mechanism.

Another object of the present invention is to provide for a rotary machine that produces an output at all angles of rotation of the shaft.

Another object of the present invention is to provide for a larger inlet port for use as a compressor or larger exhaust port for use as an engine.

Another object of the present invention is to form a better seal between the high-pressure inlet and exhaust port allowing for less reliance on the apex seals.

Another object of the present invention is to have a valve that can better deliver over pressurized gases to a volume located after the high-pressure outlet to more rapidly fill this volume.

Another object of the present invention is to provide a means to control flow to chambers inside the rotor.

These and other objects of the present invention are attained in one embodiment comprising a two-lobe rotor that is lenticular or substantially elliptical displaced within a chamber for eccentric rotation. A slidably mounted seal in the region of the center of the least volume portion formed between the rotor apexes in the housing chamber is used to seal against the periphery of the rotor. The seal is slidably mounted to adjust for the variation in position of the periphery of the rotor along the direction parallel to the line of motion of the sliding seal as the rotor moves through a cycle of rotation. The magnitude of the variation in position increases as the seal is mounted further from the center of the least volume position. The high-pressure port is placed such that the seal against the periphery of the rotor isolates the high-pressure port from the low-pressure port. A second seal is slidably mounted but positioned separate from the first seal. The second seal is positioned in the least volume region on the opposite side of the high-pressure port. The effect is to create a separate working or expansive volume for the machine that is separate from the high-pressure inlet. The second seal can then be used as a valve by being lifted from contact with the surface of the rotor by external means or internally by interaction with the rotor. The use of a largely stationary contact in this region would greatly limit the applicable rotor geometry and the amount of separation of the seals from the center of the smallest volume region of the machine.

A more sophisticated embodiment has a set of slidably mounted seals in the smallest volume region housing with the seals being stacked along the length of the rotor. The rotor has two larger side sections and a smaller central section. The larger side sections of the rotor seal against the side of the slidably mounted seals while the tips of the seals are in contact with the outer peripheral surface of the smaller central rotor section. This can provide a moving thermal barrier for the side housing. A slidably mounted seal is on either side of the central seal and seals against the outer periphery of the larger rotor side sections. A stack of three seals is used on one side of the high-pressure port to separate the high and low-pressure ports. Another stack of three or more seals is used on the opposite side of the high pressure port to act as a valve and seal between the high pressure port and working or expansive volume of the machine.

Placing a channel on a portion of the periphery of the rotor and using a single vane between the high-pressure port and working volume can create a valve action. As the channel slides under the tip of the flow regulation seal an opening between the high-pressure port and working volume is created. When the end of the channel passes the seal, there is once again a seal between the high-pressure port and working volume. The seal between the high-pressure port and low-pressure port for this embodiment is maintained by using a stack of three slidably mounted seals such that the center seal slides through the channel and maintains a seal against the bottom and sides of the channel. The open region in the channel sliding under the flow regulation seal accomplishes the effect of lifting the vane by external means.

Another embodiment for the invention takes into consideration that the rotor surface can be cut such that the seals move towards the center of the chamber as the rotor approaches the position corresponding to the smallest volume region formed by the rotor apexes. A single seal between the high-pressure port and working volume can be used as a valve by constraining the seal from moving far enough to contact the rotor periphery for positions where the valve is wanted to be open. This would be instead of using multiple seals with a channel or mechanically lifting of the seal. There is an additional significance to having the seals moving inward as the rotor moves toward the top dead center position in that greater volume is displaced as the rotor approaches the top dead center. There is a very small working volume when the valve opens but the working volume from the previous cycle is still in an expansion or compression mode. The effect is to produce more even torque for all angles of rotation of the shaft.

The improvements hereto apply to machines having rotors with more than two apexes such as the three-lobe Wankle configuration. The seal assembly is again placed within the central portion of the least volume region.

The introduction of the slidably mounted seal mating against the periphery of the rotor has been applied to several rotary machines but the use of the seal for an intake or outlet valve has not. The same method of using the seal separating the working volume from an inlet or discharge port in conjunction with a seal on the other side of the port separating volume regions as described in prior art can be used as a valve. This can replace the mechanically actuated valve or check valve for a broad class of these machines.

DETAILED DESCRIPTION OF THE PREFERRED EMBODIMENTS

As will be seen herein, the present invention will be described with reference to a number of different rotary machines. Examples of rotary machines to which the present invention is directed, includes compressors and power expanders. As will be seen herein, the present invention has found immediate application to rotary machine housings defining a conventional internal cartiod cavity, with the rotor traversing, i.e., contacting the walls of the cartiod cavity. It will be readily appreciated by those skilled in the art that the present invention may be readily adapted to rotary machine housings having different internal cavity shapes, such as the two lobe rotor, three lobe Wankle type rotor, and multi lobe rotor.

Figure 1:
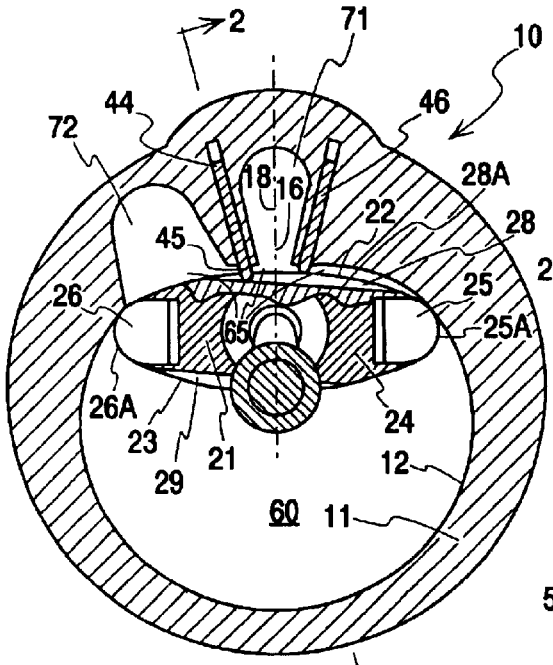
FIG. 1 is a cross-sectional view taken along the line 1—1 of FIG. 3.
Figure 2:
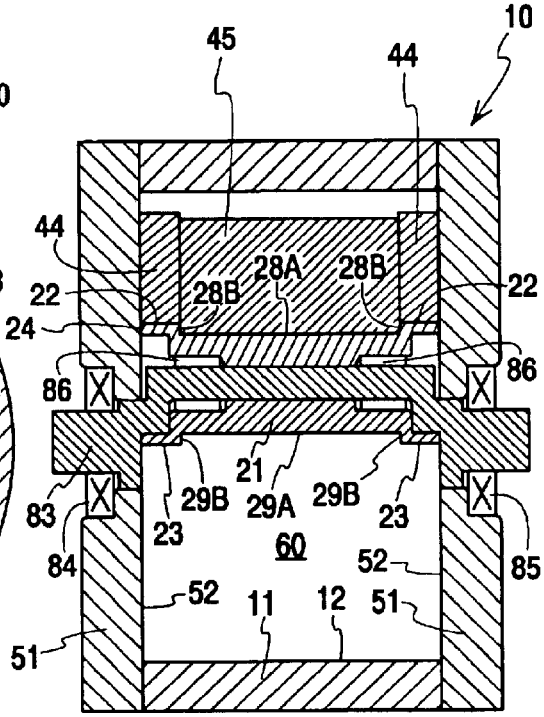
FIG. 2 is a cross-sectional view taken along the line 2—2 of FIG. 1.
Figure 3:
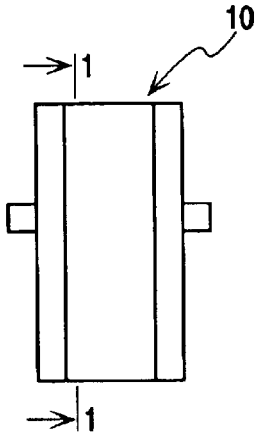
FIG. 3 is a side elevational view of a rotary machine (e.g., compressor or power expandor) according to principles of the present invention.

Referring now to FIGS. 1–3, a first embodiment of a rotary machine according to principles of the present invention includes outer housing 11 having inwardly facing annular wall 12 and side housings 51 having inwardly facing end walls 52. The outer housing 11 and side housings 51 are joined together by annular wall 12 and end walls 52 defining chamber 60. The rotary machine is generally designated by the reference numeral 10.

A substantially elliptical or lenticular two-lobe rotor assembly 21 having a periphery 22, 23 extending between rotor apexes 25, 26 and smoothly transitioning to apex peripheries 25*a*, 26*a*. Two channels 28, 29 are disposed within rotor peripheries 22 and 23 having a bottom 28*a*, 29*a* and parallel channel sides 28*b*, 29*b*. The rotor side faces 24 seal against end walls 52.

In order to control movement of rotor assembly 21 a rotor positioning mechanism is needed but not shown. This could be of a wide variety described in prior art. A shaft 83 rotates in bearings 84 and 85, and shaft 83 with eccentric crank pin rotating in rotor bearings 86 is rotated by the rotor and produces torque. The shaft could be of other varieties described by prior art.

There is a slidably mounted seal assembly with at least 4 slidably mounted seals comprised of high-pressure seals 44, 45 and flow regulation seal 46. The seals are mounted in the housing about the center of the minimum volume region 65 between the rotor apexes 25, 26 shown in FIG. 1 and FIG. 7*b*. The high-pressure seals 44, 45 slide radially to adjust for relative movement of the point of contact with the rotor peripheries 22, 23, apex peripheries 25*a*, 26*a* and channel bottoms 28*a*, 29*b* while flow regulation seal 46 follows rotor peripheries 22, 23 and apex peripheries 25*a*, 26*a*. The slidably mounted seals are generally kept in contact with the rotor 21 by some means of producing force inward towards the rotor. As an alternative, one of the seals could be kept stationary, by sloping the rotor for example.

Referring to FIG. 1, the machine housing defines a cartiod-shaped internal cavity having a pre-selected volume. In the illustrated embodiment, the rotor occupies approximately 28% of the housing cavity volume. By subtracting the rotor volume from the housing cavity volume, an available volume can be determined. As shown at the instance of operation in FIG. 1, the rotor divides the available volume between a first minimal size available volume portion 65 of 3% and a remaining much larger available volume portion of 69%. As can be seen in FIG. 1, the rotor is located at its topmost position, with the theoretical center of the projection 16 of the cartiod cavity lying along a center line of the rotor which divides the rotor into generally equal lefthand and right-hand parts. The projection 16 will be described in greater detail in subsequent description. In FIG. 1, the center line is identified by reference number 18. As can be seen in FIG. 1, the machine housing defines two vane locations lying along converging lines, forming mirror images with respect to section line 48. In the preferred embodiment shown in FIG. 1, the vane locations are defined by generally equally sized slots formed in the machine housing. Each vane location, i.e., each slot, accommodates at least one slidably movable vane and if desired, multiple vanes can be accommodated in each slot. For example, in the arrangement shown in FIG. 2 vane 45 is located between a pair of vanes 44. The vanes 44, 45 are independently movable with respect to one another. As can be seen in FIG. 1, the vane locations or slots are located in the small volume portion identified by reference numeral 65 in FIG. 1, and the projection 16 of the cartiod cavity lying along reference line 18 generally divides the small volume 65 into equal portions. Preferably, the vane locations have defined operational assignments, with the slot or vane location to the left of reference line 18 containing three or more full time reciprocating seals and the vane location to the right of reference line 18 containing one or more reciprocating valving seals. Although the vane locations in the illustrated embodiment are shown as generally equal size and mirror images of one another, it is generally preferred that the vane locations are not centered with respect to the protruding region 16 of the cartiodal cavity. As explained above, the present invention provides an additional working volume which is formed between the two vane locations, the protruding region of the cartiodal cavity and the upper surface of the rotor. In general, the entire vane assembly can be located to either side of the center of the protruding region 16, and multiple working volumes between multiple vane assemblies can be created.

Figure 4:
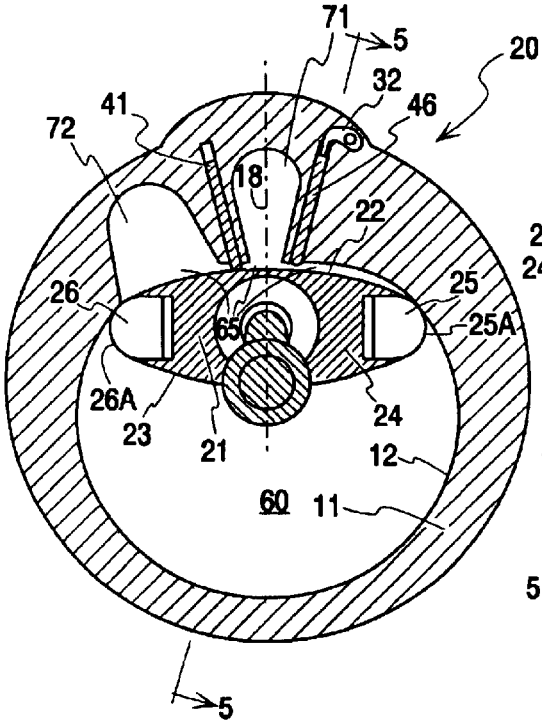
FIG. 4 is a cross-sectional view taken along the line 4—4 of FIG. 6.
Figure 5:
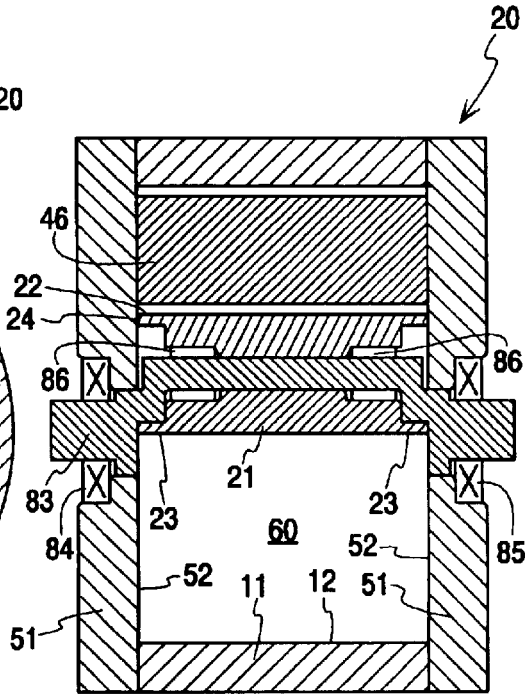
FIG. 5 is a cross-sectional view taken along the line 5—5 of FIG. 4.
Figure 6:
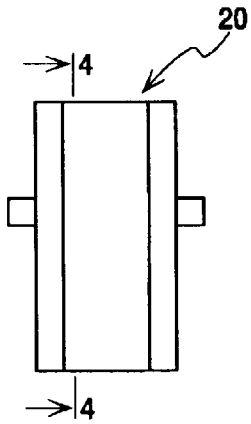
FIG. 6 is a side elevational view of a rotary machine (e.g., compressor or expandor) having a mechanically actuated flow regulation seal.

A second embodiment of a rotary machine 20 as shown in FIGS. 4–6 differs from the first embodiment in that a different type of high-pressure seal 41 replaces the three high pressure seals 44, 45. For this case the flow regulation seal 46 is separated from contact with the rotor periphery 22 or 23 instead of channel 28 or 29 moving underneath the flow regulation seal 46. This can be accomplished by producing a force radially outward on the regulating seal lifter 32 or by constraining the seal from further inward radial movement and shaping the rotor periphery to cause separation from the seal. Subsequent description of operation of the device assumes movement of the channel under flow regulation seal 46 as being synonymous with the lifting of flow regulation seal 46, as should be apparent to those skilled in the art.

FIGS. 7*a* to 7*g* shows seven successive positions of the operating cycle. Of the first embodiment of a rotary machine according to principles of the present invention, as illustrated in FIGS. 1–3. The operation of the slidably mounted seals 44, 45, and 46 will be described for a first embodiment acting as an expander of gases while deriving power in the form of rotation of shaft 83 producing torque. The reversal of this process would describe a compressor.

Figures 7A, 7B, 7C, 7D, 7E, 7F, 7G:
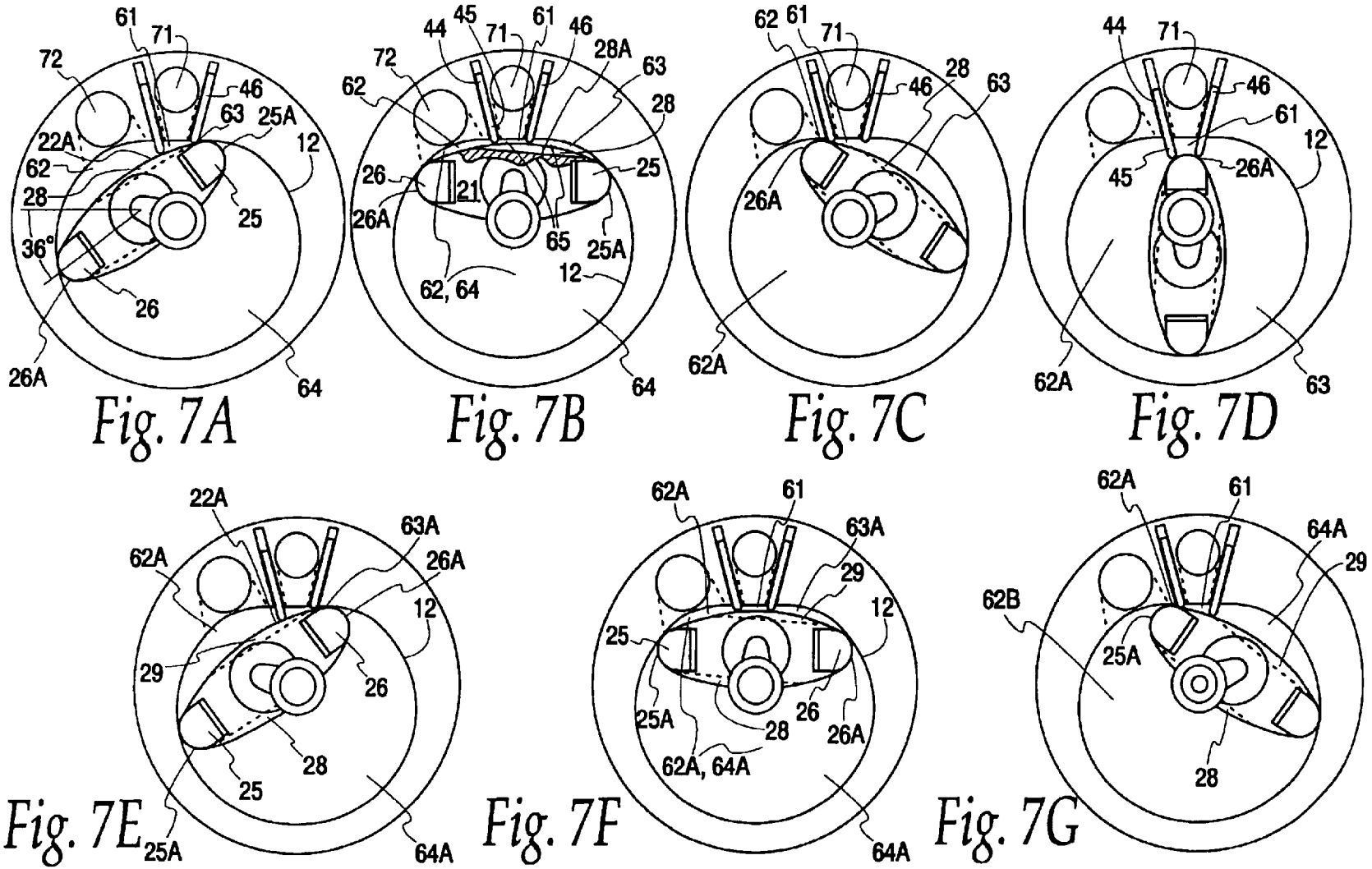
FIGS. 7*a*–7*g* are views similar to that of FIG. 1 but showing a series of consecutive operating positions.
Figure 10A:
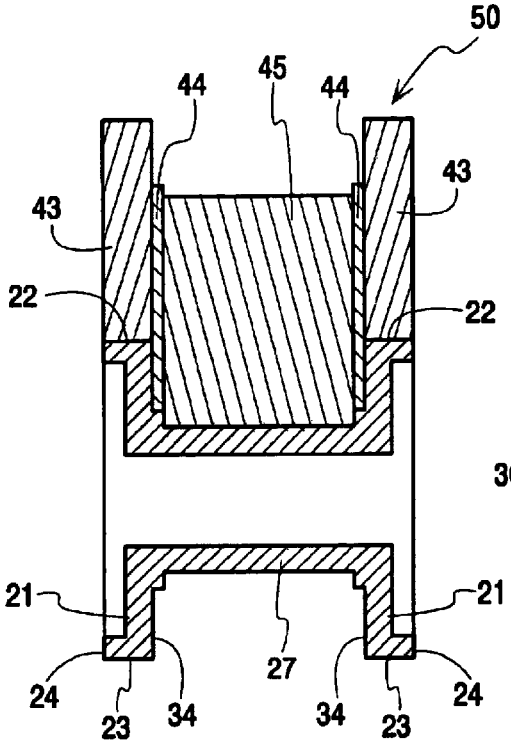
FIG. 10*a* is a fragmentary cross-sectional view taken along the line 10*a*—10*a* of FIG. 9.
Figure 10B:
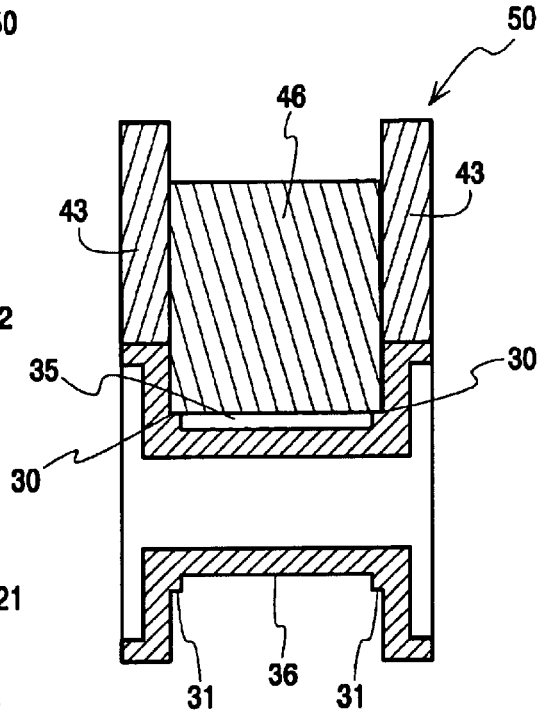
FIG. 10*b* is a fragmentary cross-sectional view taken along the line 10*b*—10*b* of FIG. 9.
Figure 10C:
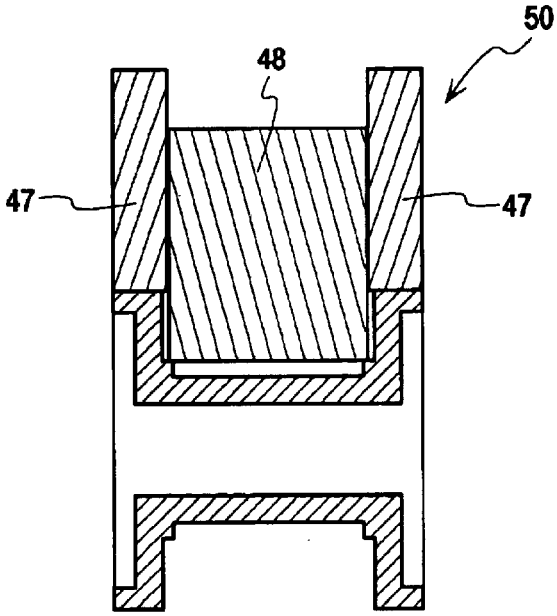
FIG. 10*c* is a fragmentary cross-sectional view taken along the line 10*c*—10*c* of FIG. 9.
Figure 8:
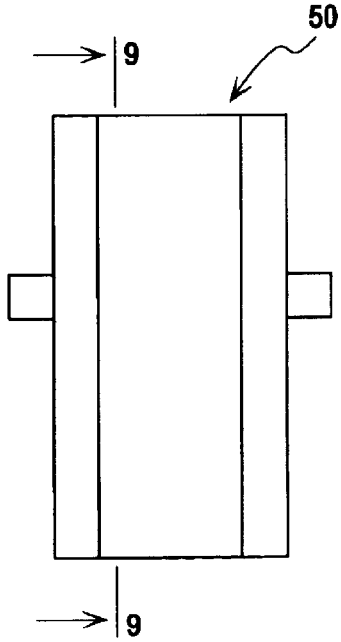
FIG. 8 is a side elevational view of another embodiment of a rotary machine (e.g., compressor or power expandor) according to principles of the present invention.
Figure 9:
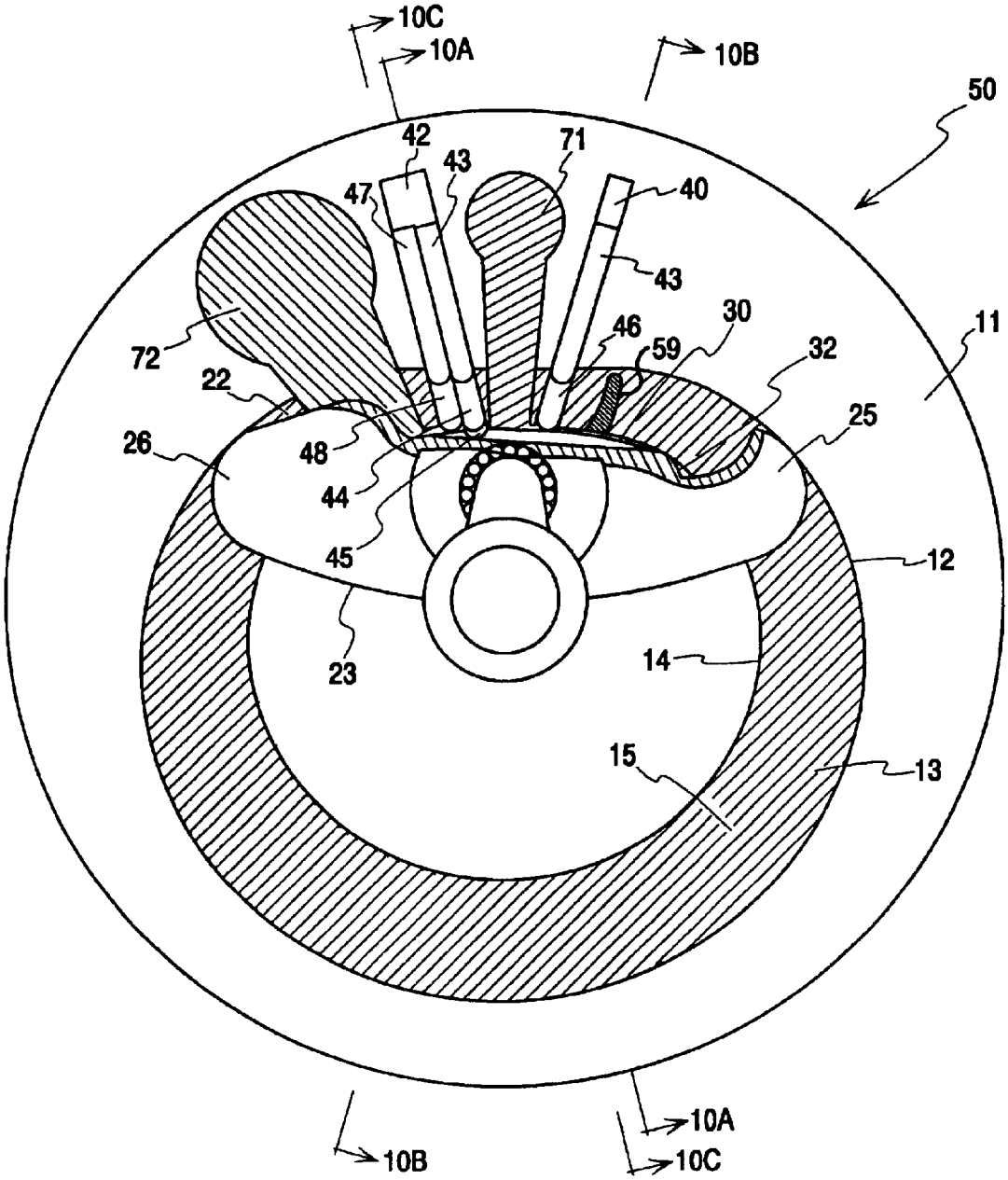
FIG. 9 is a cross-sectional view taken along the line 9—9 of FIG. 8.

The position of FIG. 7*a* is near the beginning of the cycle. The contacts of the flow regulation seal 46 transitions from the periphery of the rotor apex 25*a* to the rotor periphery 22. A high-pressure port 71 is disposed between high-pressure seals 44, 45 and flow regulation seal 46 that enclose volume 61. The rotor apex periphery 25*a* is moving into contact with housing annular wall 12 and forms an enclosed volume 63 between the flow regulation seal 46 and apex periphery 25*a* contact with annular wall 12. After volume 63 is formed, continued clockwise rotation from the position of FIG. 7*a* causes the contact of seal 46 to begin to pass over channel 28 and open volume 63 to volume 61 and high pressure port 71. Volume 63 is very small resulting in a very small unusable volume for the high-pressure gases to fill. This is in contrast to a much larger unusable volume described in prior art corresponding to the minimum volume 65 between the rotor apexes 25 and 26 shown in FIG. 7*b*.

A volume 62 exists, between high pressure seals 45, 44 and rotor apex periphery 26*a* contact with annular wall 12, which is open to low pressure port 72. High pressure seal 45 is the same width as channel 28 to maintain seal with the channel sides 28*a* and channel bottom 28*b*, while high pressure seals 44 form a seal against rotor periphery 22 as shown in the axial view of FIG. 1.

FIG. 7*a* is near the position of the cycle where volume 64 is formed between apex periphery 25*a*, 26*a* contact with annular wall 12 on the opposite side of the rotor from the slidably mounted seals. It will be shown that the formation of the contact of apex periphery 25*a* with annular wall 12 causes an expanded version of volume 63 to become volume 64.

The top center position of the rotor is shown in FIG. 7*b*. The size of volume 63 has increased from the beginning of the power stroke shown in FIG. 7*a* allowing the production of output torque on shaft 83 due to the transferal of high pressure gases into volume 63. Volume 64 has separately expanded further to its maximum volume from the volume 64 shown in FIG. 7*a* and derived energy from the expansion of gases introduced from the previous cycle. As can be seen by comparing FIG. 7*b* to FIGS. 7*a* and 7*c*–7*e*, the rotor divides the internal housing cavity into two volume portions having the greatest size disparity. The top of the rotor cooperates with the machine housing to form an available cavity volume of minimal size for the machine. The opposing or bottom portion of the rotor cooperates with the machine housing to form a second much larger, i.e., maximum available volume size. For the preferred cartiodal housing cavity shape, the small available volume is centered generally about the projection area of the cartiodal shape. The rotor periphery shape of this position, however, will effect output torque due to the creation of multiple working volumes within this cavity region 65. In the illustrated embodiment, the vane locations located on either side of the cartiodal projection are spaced relatively close together, and the vane locations lie along converging lines separated by an angular displacement of 15%. To minimize vane travel and vane tip pressure angles with rotor as a preferred embodiment the vanes are on converging lines, but there is no requirement.

Further rotation from the top center position of FIG. 7*b* causes volume 64 to open and combine with volume 62 that is open to low pressure port 71. There is not a seal at the between the apex periphery 26*a* and annular wall 12 due to the passage of apex 25 over exhaust port 71. Volume 62 and 64 combine to form the new volume 62 and 64. As an intake for a compressor, for example, this would correspond to a greater volume intake of gases. For the machine of embodiment one used as an expandor volumes 62 and 64 both contain gases to be exhausted. The exhaust stroke begins for exhaust gases from the previous cycle of rotation at the position shown in FIG. 3*b*.

FIG. 7*c* shows volume 64 has reduced to a very small volume displacing almost all gases from this volume. Just beyond this position shown in FIG. 7*c* the apex periphery 26*a* comes out of contact with the annular wall 12 forming volume 62*a* from volume 64. Volume 63 is isolated from volume 61 by flow regulation seal 46 passing beyond channel 28 and the gases contained within volume 63 begin an expansion process.

The bottom most position of the rotor in FIG. 7*d* shows volume 63 further expanding the gases contained within and volume 62*a* displacing gases out the exhaust port 72. The high-pressure inlet 71 is isolated from volume 63 by flow regulation seal 46, and volume 62*a* is isolated from high-pressure inlet 71 by high-pressure seals 44, 45.

As the rotor moves further through the cycle to the position shown in FIG. 7*e*, the apex periphery 26*a* forms a contact with annular wall 12 and volume 63 becomes volume 64*a* which will continue the expansion process. A new power stroke begins with the formation of volume 63*a*. FIG. 7*f* is at the top center position however this is not the end of the cycle. The cycle is completed when the exhaust cycle has ended near the position of FIG. 7*g* where volume 62*a* is at a minimum and apex periphery 25*a* no longer seals against annular wall 12.

Referring now to FIGS. 8, 9, and 10*a*–*c*, a third embodiment of a rotary machine 50 includes two outer housing sections 11 and an additional center housing section 13 having inwardly facing annular walls 12, 14, inner end walls 15. Outer housing sections 11, 13 and side housings 51 as described in the first embodiment are joined together with annular walls 12 and 14, housing inner end walls 15, and side walls 52.

There is a two-lobe rotor comprised of two rotor sections 21 having curved faces 22, 23 meeting at symmetrically opposed apexes 25 and 26, a smaller center rotor section 27 having rotor peripheries 30, 31 extending between rotor apexes 32, 33. The rotor assembly will have four side faces 24, 34 shown in FIG. 8 which seal against housing inner end walls 15 and side walls 52 as described in FIG. 1. There are additionally channels 35, 36 in center rotor section 27 which serve the same function as the channels 28, 29 of the first embodiment, however these are disposed within a smaller rotor section. There is an internal port 59 interconnecting connecting the volume contained within the larger housing and rotor volumes and smaller central section corresponding in function to the volume 63 of FIG. 7*b*. It is assumed that some means of connecting these volumes is used in order to allow the high pressure gases to fill the volume corresponding to the larger rotor and housing section.

The third embodiment of FIGS. 8, 9 and 10*a*–*c* comprise a more sophisticated radial seal assembly having eleven slidably mounted seals 43–48 that move radially in slots 40, 42. Like numerals are used for high-pressure seals 44, 45 and flow regulation seal 46 shown in the axial view of FIG. 3. These serve the same function as the first embodiment with the exception that the seals form a seal against the moving inwardly facing side faces 34 of the rotor sections 21. The slidably mounted seals 43 seal against rotor peripheries 22, 23 and additional high-pressure slidably mounted seals 47, 48 are an example of seals to help seal between high pressure seals 44, 45. It is assumed that more seals for the high pressure side and flow regulation side could be applied.

The third embodiment 50 also includes high pressure port 71 located within outer housing 11 between the radial vanes 44, 45, and 46. High-pressure port 71 is open to volume 61 enclosed by vanes 43–48 and the inwardly facing rotor side faces 34. The high-pressure inlet for this case can be designed with the high-pressure port having a thermal insulating liner and the slidably mounted seals can be positioned by external means such that there is no actual contact but a close contact with the rotor periphery. For example, this combined with the cyclic nature of applicable cycles could result in the use of very high inlet temperatures. Located within outer housing 11 is low-pressure port 72 that extends further into the housing than the first embodiment.

Figure 12:
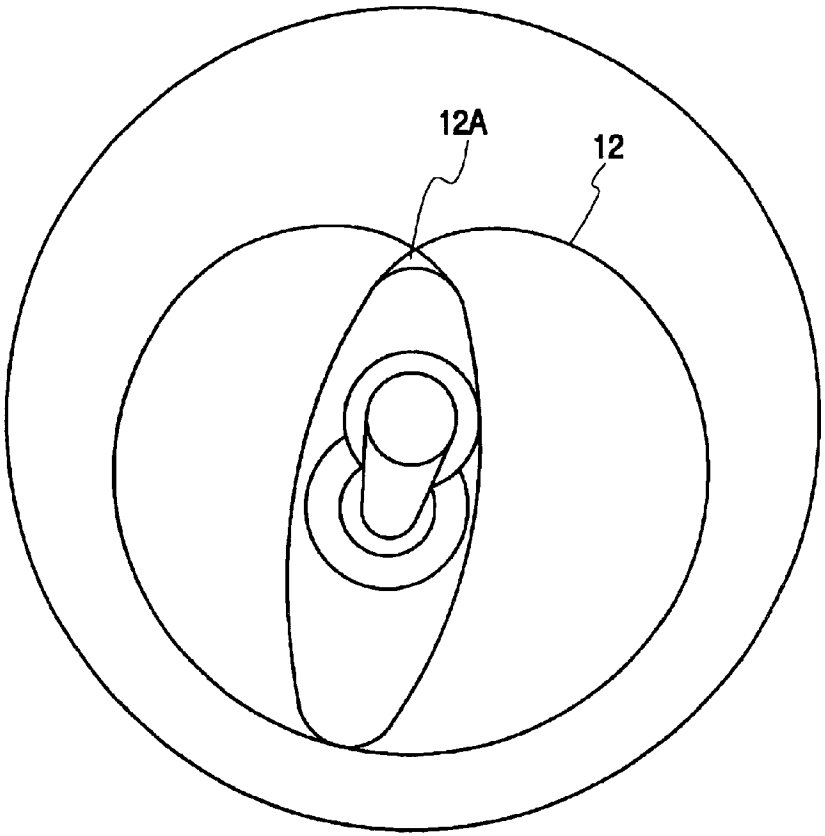
FIGS. 11 and 12 are schematic end elevational views of a rotary machine according to principles of the present invention.
Figure 11:
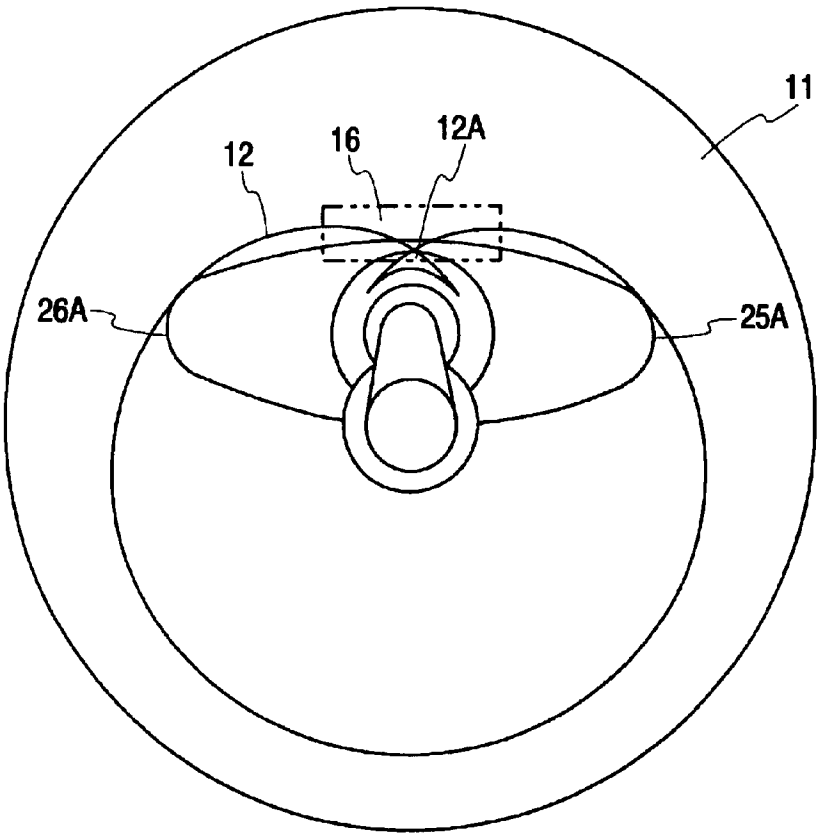

The use of the radial vane assembly in general allows for a much smaller rotor assembly. The outer housing 11 in FIGS. 11 and 12 is shown without slidably mounted seals. The outer housing annular wall 12 has an additional protruding portion 16 of annular wall 12 that penetrates significantly beyond rotor periphery 22. There is an overlapping portion of the annular wall 12*a* that represents theoretical points of contact of the rotor apex peripheries 25*a* and 26*a*, however the annular wall here can not physically exist.

Figure 14:
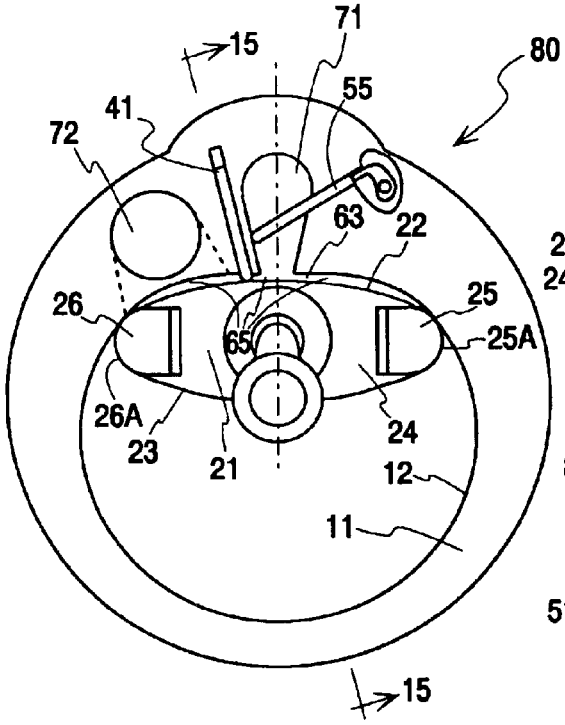
FIG. 14 is a cross-sectional view taken along the line 14—14 of FIG. 13.
Figure 15:
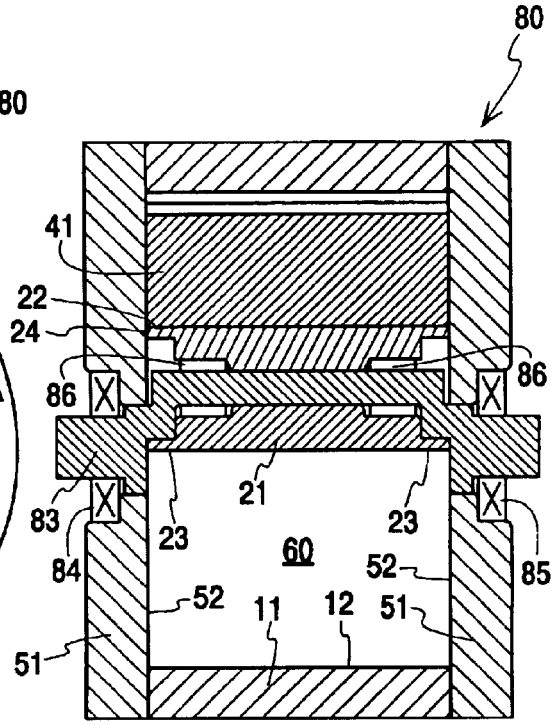
FIG. 15 is a cross-sectional view taken along the line 15—15 of FIG. 14.
Figure 13:
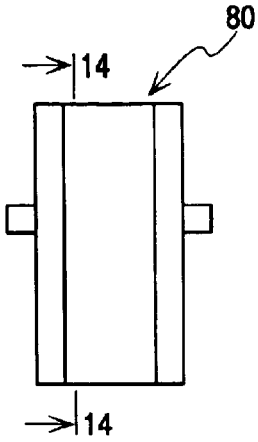
FIG. 13 is an elevational view of a further rotary machine (e.g., compressor or power expandor) according to principles of the present invention.

A fourth embodiment 80 depicted in FIGS. 13–15 is perhaps the simplest form of the invention and has the feature of a single slidably mounted high-pressure seal 41. The high-pressure seal 41 moves towards the housing center to maintain the seal against the rotor as the rotor is rotated half way through the cycle and moves outwards from the housing center to allow the rotor to pass through the top dead center position. The absence of a reciprocating vane to make a sliding contact on the periphery of the rotor as described in prior art would limit the size of the rotor and high pressure seal positions. Additionally, more control of the torque curve for angular position of the rotor by offsetting the vane position to either side of the cartiodal projection. The opening of valve 55, which in this case could be any suitable mechanically actuated valve or check valve for application of the device as a compressor, corresponds to the opening of the flow through channel 28 under the flow regulation seal 46 of the first embodiment.

Figure 16A:
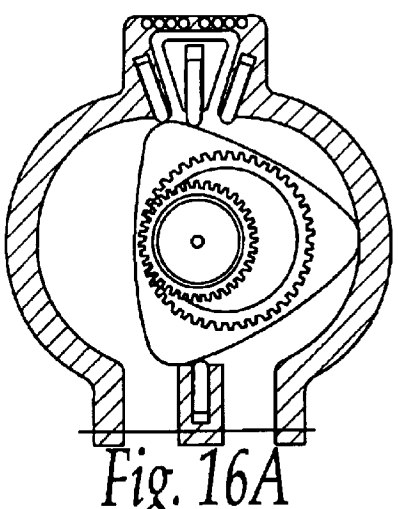
FIGS. 16*a*–16*n* are views of a three lobe rotor configuration showing the slidably mounted seals forming two valves and a single slidably mounted seal separating inlet and exhaust.
Figure 16B:
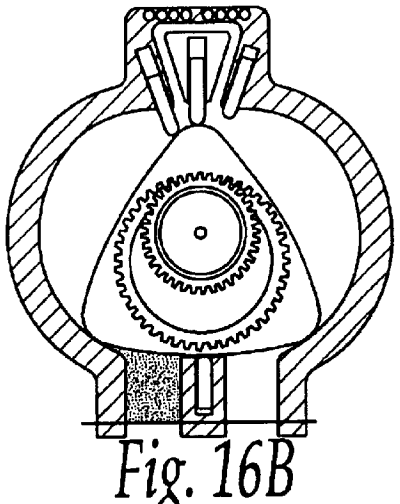
Figure 16C:
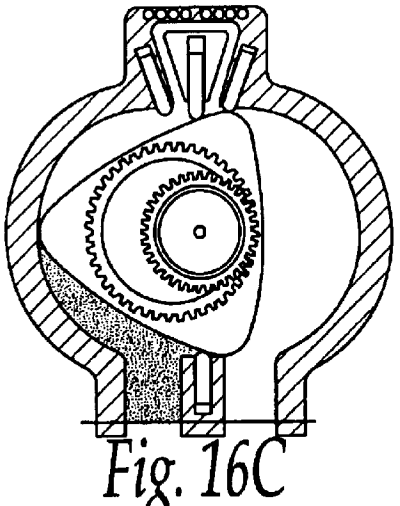
Figure 16D:
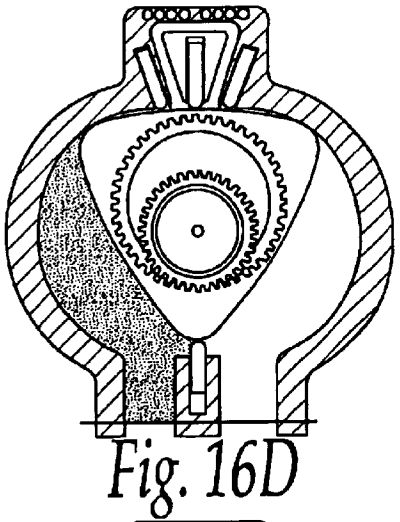
Figure 16E:
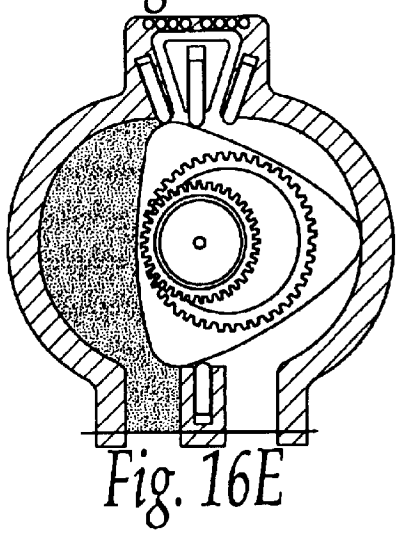
Figure 16F:
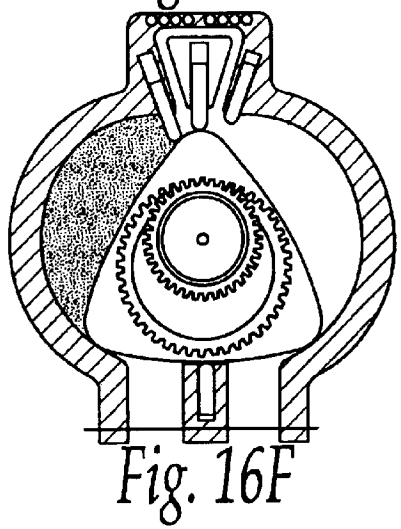
Figure 16G:
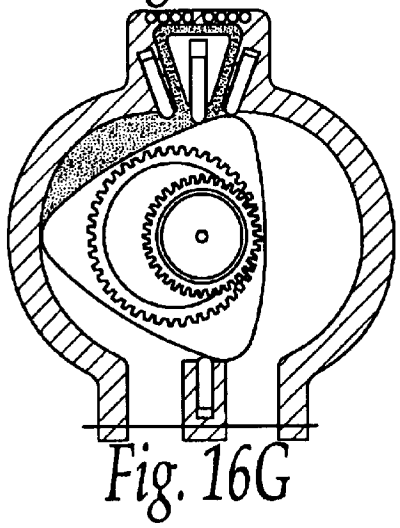
Figure 16H:
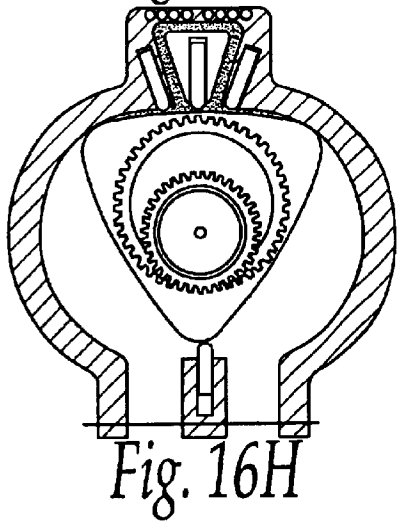
Figure 16K:
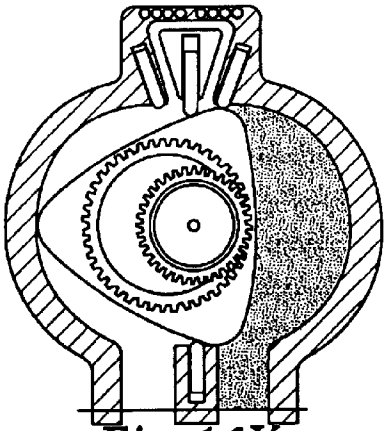
Figure 16N:
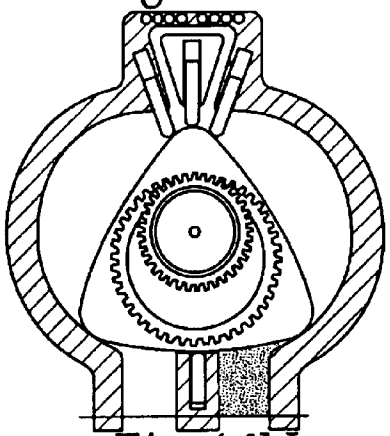
Figure 16J:
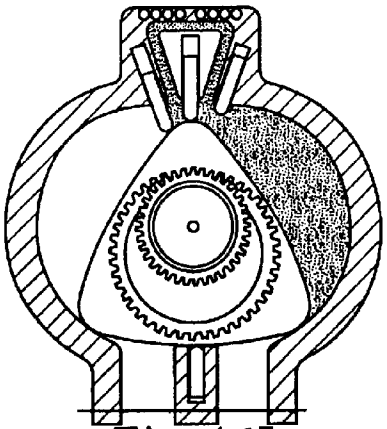
Figure 16M:
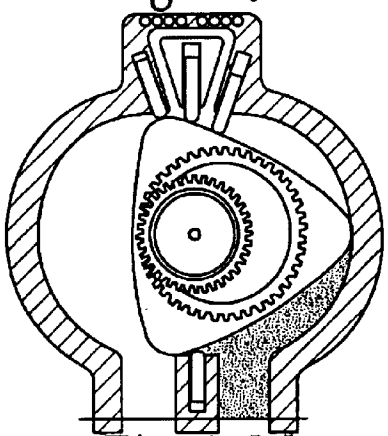
Figure 16I:
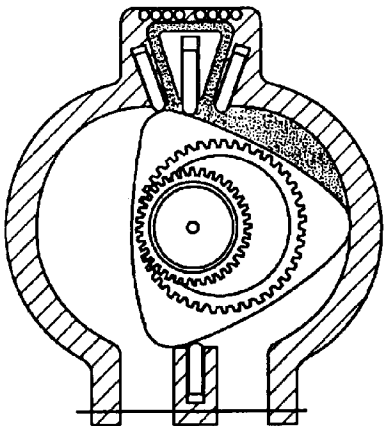
Figure 16L:
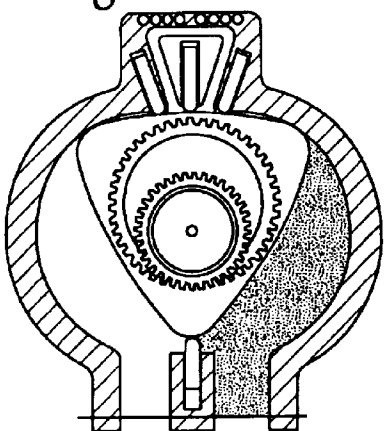

An embodiment using reciprocating vanes in the cartiodal projection region to create multiple working volumes is shown in FIGS. 16*a*–16*n*. Successive positions of a three-sided rotor embodiment show a full cycle of compression and expansion. The embodiment has a valving seal on either side of the center pressure seal to form two working volumes with the left volume acting as a flow regulating valve for compression and the right volume acting as a flow regulating valve for the expansion. The second cartiodal protrusion has a single vane to completely separate intake and exhaust of the device. This embodiment depicts a typical heat engine or heat pump configuration.

Figure 17:
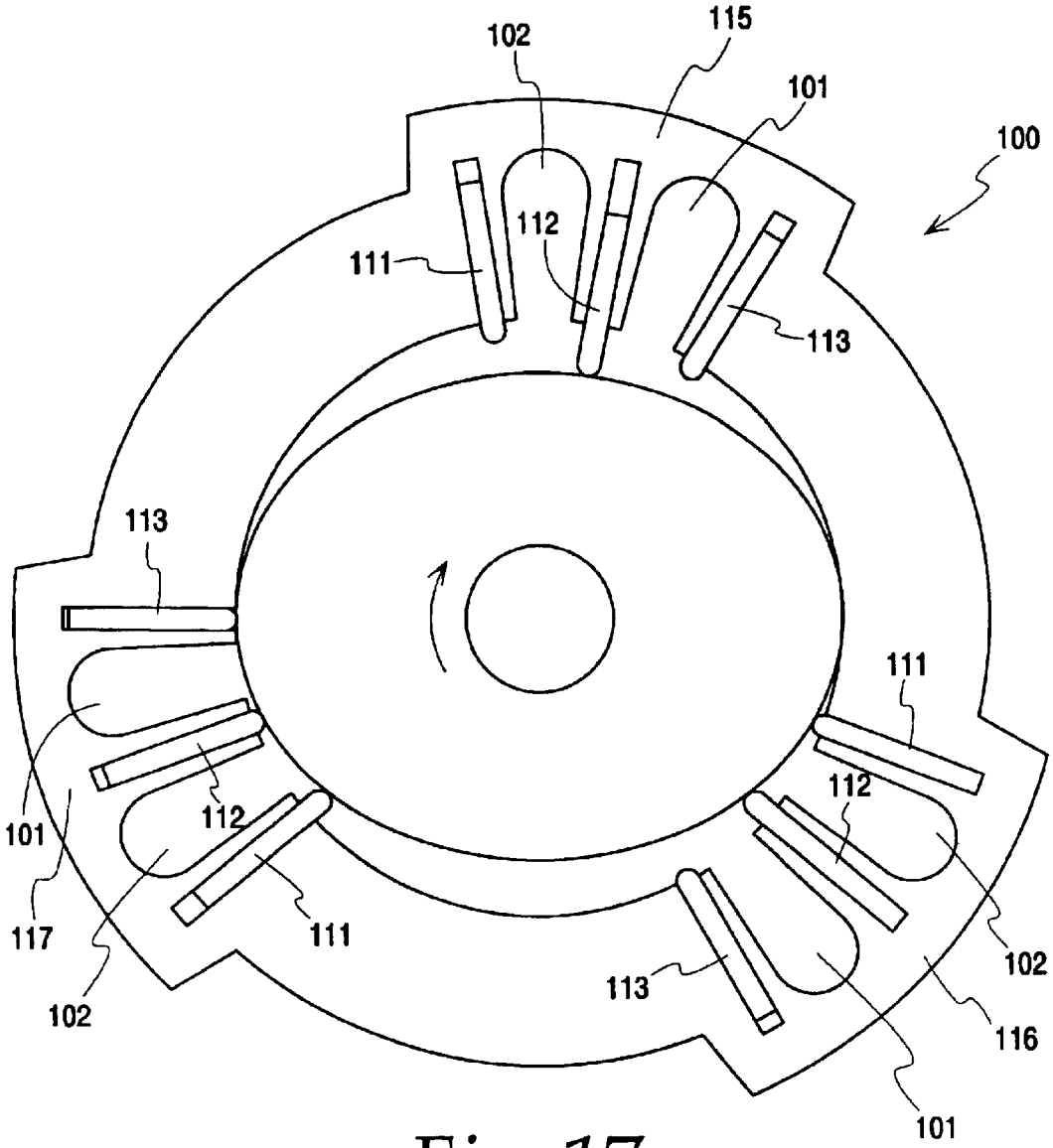
FIG. 17 is a view of an embodiment having a rotor providing for fixed axis rotation.

An embodiment of a rotary machine 100 depicting the valving and pressure seal combination is shown in FIG. 17. This machine used as a compressor has inlet port 101 in seal assembly 115 open to the working volume by valving seal 113 being lifted from contact with the rotor periphery. The valving seal 113 of seal assembly 116 is also open and the volume down stream is near the maximum. The valving seal 113 of seal assembly 117 is sealing the flow of the inlet similar to the closing of a check valve for a compressor of this type. Pressure seal 112 is always sealing against the periphery of the rotor and is the same in function as that for prior art of this type of compressor. Valving seal 111 regulates flow to outlet port 102. The valving seal 111 of seal assembly 115 is open and the upstream volume is reducing in size. The valving seal 111 of seal assembly 116 is closing and near the end of the displacement cycle. This serves to eliminate the unusable volume and adverse expansion. The valving seal 111 of seal assembly 117 is just opening and the upstream volume is at a maximum. It is to be understood that the valving action could have alternatively been accomplished using a channel as described for machine 10 of FIG. 1.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A rotary machine comprising:

a housing with an internal wall defining a working volume;

a rotor mounted for rotational movement within the working volume, said rotor having first and second curved faces meeting at apices;

means for rotating said rotor within said housing;

said housing defining first and second spaced apart generally side by side vane locations communicating with said working volume;

first and second vanes having a rotor-contacting end, disposed in each said vane location;

said rotor movable within the working volume to a top position so as to contact said internal wall to divide said working volume into a first minimum size working volume and a second much larger size working volume;

said vane locations communicating with said minimum size working volume so that the rotor-contacting ends of said vanes contact spaced apart portions of said first rotor curved face;

said first and said second vanes comprising a first full time reciprocating seal with a first portion of said first rotor curved face and a second reciprocating valving seal with a second portion of said first rotor curved face;

said first vane reciprocably movable in said first vane location for movement of its rotor-contacting end to maintain substantially continuous seal forming contact with said first rotor curved face as said rotor moves in said housing;

said second vane reciprocably movable in said second vane location for movement of its rotor-contacting end toward and away from said first rotor curved face to form a selectable valving seal contact with said first rotor curved face; and so as to form a selectably openable additional working volume between the rotor-contacting ends of said vanes, said first rotor curved face and said internal wall.

2. The rotary machine of claim 1 further comprising intake and outlet ports in communication with said working volume, cooperating to provide a positive displacement pumping action as said rotor is moved within said housing.

3. The rotary machine of claim 1 further comprising intake and outlet ports in communication with said working volume, cooperating to provide expansion of a high pressure fluid inputted to said intake port as said rotor is moved within said housing.

4. The rotary machine of claim 1 further comprising intake and outlet ports in communication with said working volume, with said outlet port located between said first and said second vanes.

5. The rotary machine of claim 1 wherein said internal wall defines a cartiodal shape having a cartiodal projection region between said first, and said second vanes.

6. The rotary machine of claim 5 further comprising a reference line extending into said working volume, dividing said cartiodal projection region and said rotor into respective generally equal sized portions.

7. The rotary machine of claim 1 wherein said first vane location is upstream of said second vane location, with respect to rotational movement of said rotor.

8. The rotary machine of claim 7 wherein multiple vanes are located in said first vane location.

9. The rotary machine of claim 7 wherein three vanes are located in said first vane location.

10. The rotary machine of claim 9 wherein said first vane location comprises a slot, with said three vanes serially disposed in said slot in a single file arrangement.

11. The rotary machine of claim 10 wherein said three vanes comprise a first larger vane disposed between smaller vanes.

12. The rotary machine of claim 7 wherein three vanes are serially disposed in said slot in a single file arrangement.

13. The rotary machine of claim 1 wherein said rotor has a generally lenticular shape.

14. The rotary machine of claim 1 wherein said rotor is mounted for eccentric movement within said housing.

15. The rotary machine of claim 1 wherein said rotor is mounted for eccentric rotational movement about a fixed axis.

16. The rotary machine of claim 15 further comprising intake and outlet ports in communication with said working volume, cooperating to provide a positive displacement pumping action as said rotor is moved within said housing.

17. The rotary machine of claim 15 further comprising intake and outlet ports in communication with said working volume, cooperating to provide expansion of a high pressure fluid inputted to said intake port as said rotor is moved within said housing.

18. The rotary machine of claim 15 further comprising intake and outlet ports in communication with said working volume, with said outlet port located between said first and said second vanes.

19. The rotary machine of claim 15 wherein said internal wall defines a cartiodal shape having a cartiodal projection region between said first and said second vanes.

20. The rotary machine of claim 18 further comprising a reference line extending into said working volume, dividing said cartiodal projection region and said rotor into respective generally equal sized portions.

21. The rotary machine of claim 15 wherein said first vane location is upstream of said second vane location, with respect to rotational movement of said rotor, and wherein multiple vanes are located in said first vane location.

22. The rotary machine of claim 21 wherein said three vanes comprise a first larger vane disposed between smaller vanes.

23. The rotary machine of claim 15 wherein said rotor has a generally lenticular shape.

24. The rotary machine of claim 15 wherein said rotor is mounted for eccentric movement within said housing.

25. The rotary machine of claim 15 wherein said rotor is mounted for eccentric rotational movement about a fixed axis.

26. A rotary machine comprising:

a housing with an internal wall defining a working volume;

a rotor mounted for rotational movement within the working volume, said rotor having first and second curved faces meeting at apices;

means for rotating said rotor within said housing;

said housing defining first and second spaced apart generally side by side vane locations communicating with said working volume;

first and second vanes having a rotor-contacting end, disposed in each said vane location;

said rotor movable within the working volume to a top position so as to contact said internal wall to divide said working volume into a first minimum size working volume and a second much larger size working volume;

said vane locations communicating with said minimum size working volume so that the rotor-contacting ends of said vanes contact spaced apart portions of said first rotor curved face;

said first and said second vanes comprising full time reciprocating seals with first and second spaced apart portions of said first rotor curved face;

said first and said second vanes reciprocably movable in their respective vane locations for movement of their respective rotor-contacting ends to maintain substantially continuous seal forming contact with spaced apart portions of said first rotor curved face as said rotor moves in said housing; and so as to form an additional working volume between the rotor-contacting ends of said vanes, said first rotor curved face and said internal wall.

* * * * *